United States Patent [19]

Zuchtriegel

[11] Patent Number: 4,949,013

[45] Date of Patent: Aug. 14, 1990

[54] HIGH-FREQUENCY OPERATING CIRCUIT FOR A FLUORESCENT LAMP

[75] Inventor: Anton Zuchtriegel, Taufkirchen, Fed. Rep. of Germany

[73] Assignee: Patent Treuhand Gesellschaft fur elektrische Gluhlampen m.b.H., Munich, Fed. Rep. of Germany

[21] Appl. No.: 311,525

[22] Filed: Feb. 16, 1989

[30] Foreign Application Priority Data

Feb. 22, 1988 [DE] Fed. Rep. of Germany ..... 3805510

[51] Int. Cl.[5] ..... H05B 41/29

[52] U.S. Cl. ..... 315/106; 315/225; 315/DIG. 5

[58] Field of Search ..... 315/106, 119, 127, 128, 315/200 R, 205, 225, 226, DIG. 5

[56] References Cited

U.S. PATENT DOCUMENTS 4,710,682 12/1987 Zuchtriegel ..... 315/210 X

*Primary Examiner*—David Mis

*Attorney, Agent, or Firm*—Frishauf, Holtz, Goodman & Woodward

[57] ABSTRACT

To provide for automatic disconnect upon failure of a filament of one (E2) of the electrodes of a fluorescent lamp, an output terminal (P1) of a power rectifier is connected through the filament to a supply terminal (P3) of a push-pull frequency generator formed by two transistors (T1, T2). The fluorescent lamp (LP) has its other electrode (E1) connected to a common terminal between two transistors (T1, T2) of the high-frequency generator. A series resonance circuit (L1, C6, C8) is capacitor-coupled (C7) to the lamp. Upon failure of the filament of the first electrode (E2), or removal of the lamp from its lamp sockets, power supply to the transistor oscillator or frequency generator circuit is interrupted, so that the oscillator is deenergized; upon insertion of an operative lamp in the lamp circuit, the circuit is closed so that the fluorescent lamp is automatically started by the push-pull oscillator (3) formed by the two transistors (T1, T2) and associated circuitry.

7 Claims, 2 Drawing Sheets

HIGH-FREQUENCY OPERATING CIRCUIT FOR A FLUORESCENT LAMP

Reference to related patents, the disclosures of which are hereby incorporated by reference: U.S. Pat. No. 4,438,372, Zuchtriegel; U.S. Pat. No. 4,481,460, Kröing et al.; U.S. Pat. No. 4,710,682, Zuchtriegel; U.S. Pat. No. 4,775,822, Statnic et al.; U.S. Pat. No. 4,808,887, Zuchtriegel, based on application Ser. No. 07/069,857, July 6, 1987 (attorney docket FF 87164shf; VPA 86P5525 U.S.); U.S. Pat. No. 4,782,268, Fahnrich et al.

Reference to related literature: "SIPMOS Transistors", SIEMENS Application Notes 1983, chapter 1.9, "Electronic ballast for fluorescent lamps", pp. 34 et seq. and equivalent general disclosure "Elektronkschaltungen" ("Electronic Circuits") by Walter Hirschmann, published by SIEMENS AG, chapter B3,12, "Elektronisches Vorschaltgerät für neue Leuchtstofflampen" ("Electronic Ballast for New Fluorescent Lamps") 50 W/220 V, a–c, pp. 147 to 151, especially page 148. German Patent Disclosure Document DE-OS 37 00 421, Fahnrich and Zuchtriegel, assigned to the assignee of the present application.

The present invention relates to an operating circuit for a fluorescent lamp, and more particularly to an operating circuit which is protected against damage due to lamp failure, while enhancing the operating effectiveness of the lamp.

BACKGROUND

It has previously been proposed to provide a disconnection circuit which is responsive to lamp failure, by disabling the operations of a push-pull transistor oscillator if a fluorescent lamp, which is supplied by the oscillator, fails—see, for example, U.S. Pat. No. 4,710,682, assigned to the assignee of the present application, and the disclosure of which is hereby incorporated by reference. This patent, in addition to the disconnection circuit, provides for reconnection, automatically, upon placing a new lamp in the lamp fittings or sockets. The circuit includes a disconnection circuit portion which, when a lamp fails, triggers a thyristor to thereby disable the push-pull frequency generator. When a new lamp is placed into the lamp sockets, it is necessary to first disconnect the circuit; about 5 seconds later, the lamp circuit can then be reenergized. Such a circuit, without automatic resetting, is disclosed in German Patent Disclosure Document No. DE-OS 37 00 421, Fahnrich and Zuchtriegel, and assigned to the assignee of the present application. This circuit is improved by the arrangement of the referenced U.S. Pat. No. 4,710,682 by providing an automatic reconnection portion, including a capacitor and a resistor. When a new, properly operating fluorescent lamp is placed in the socket, a previously positively charged electrode of the capacitor is connected with the negative terminal of a rectifier power supply. This causes reverse recharging of the capacitor, or reversal of polarity thereof, which, thereby, removes holding current from the disconnect-thyristor, so that the disconnect-thyristor will block and thereby permit the push-pull oscillator to start oscillating, without requiring, previously, disconnection of the energization circuit for the lamp.

THE INVENTION

It is an object to improve the disconnect-reconnect circuitry for the lamp, in case of lamp failure, and especially to improve the restarting of a new lamp, placed into the lamp sockets.

Briefly, a connection circuit is provided from one of the output terminals of the power rectifier to and through one of the lamp filaments, by connecting the output of the power rectifier to one of the respective filament terminals, the other one of the filament terminals being connected to one of the supply terminals for the operating circuit for the transistor push-pull frequency generator.

The arrangement by using the filament of one of the electrodes as a connection element for the supply of the push-pull frequency generator has the advantage that the current supply to the frequency generator is interrupted if there is no lamp in the lamp socket or if, for example, the filament of the lamp is broken, or, otherwise, the filament circuit is interrupted. The result is that the push-pull oscillator will be deenergized.

The arrangement has the additional advantage that, if the fluorescent lamp circuit also includes a disconnect circuit, as described in the referenced U.S. Pat. No. 4,710,682, the disconnect circuit likewise becomes deenergized and no power is lost in a holding circuit for the disconnect thyristor.

Upon placement of a new, operative lamp in the sockets, the filament of the electrode will close the current supply circuit to the push-pull transistor oscillator. The push-pull transistor oscillator can, then, immediately start oscillating to build up its operating voltage. The disconnect circuit previously had been deenergized. This provides for automatic self-restarting of the fluorescent lamp.

The arrangement has the additional advantage that by placing the filament of one of the electrodes between the power rectifier and the push-pull output circuit, direct current flow can pass through the filament, thus increasing the preheating effect thereof. This can be obtained with various types of low pressure discharge lamps, typically fluorescent lamps, for example to operate fluorescent lamps of 30 W rating and lower. For higher powered fluorescent lamps, for example for over 30 W, uniform loading of the two filaments of the two electrodes by preheating current can be readily obtained by connecting, in accordance with a feature of the invention, a diode across the filament which is connected between the power rectifier and the push-pull generator. The diode is coupled to block high frequency flow so that the preheat current will be dropped to not quite half the value absent the diode. The diode can, of course, also be used with lower power lamps.

DRAWINGS

FIG. 1 is a highly schematic block circuit diagram of the circuit in combination with a low-pressure discharge lamp, such as a fluorescent lamp; and FIG. 2 is a detailed circuit diagram of the lamp-circuit combination.

DETAILED DESCRIPTION

A fluorescent lamp LP is connected through a high-frequency or line filter 1 to a source of alternating current, for example of power network voltage and frequency, e.g. 110/220 V, 60 or 50 Hz. The high-frequency filter 1 is coupled to a rectifier 2 which, in turn, supplies a push-pull frequency generator 3. The frequency generator 3 includes a series resonance circuit and a turn-off circuit. The lamp LP is a fluorescent lamp, and has two electrodes E1, E2, with two terminals each. The two terminals of the electrode E1 are connected to the push-pull generator 3.

In accordance with a feature of the invention, the electrode E2 has one terminal connected to one of the power output terminals of the power rectifier 2, in the example shown with the positive terminal of the power rectifier P1. The other terminal of the electrode E2 is connected with the input P3 of the push-pull frequency generator 3.

A harmonic filter 4 is provided, connected between the power rectifier 2 and the corresponding filament terminal of the electrode E2, as illustrated, between the positive terminal of the power rectifier and the corresponding terminal of the electrode E2. In accordance with a preferred feature of the invention, a diode D9 is connected across the electrode terminals E2. This diode D9 is not strictly necessary, but preferred, as will appear. The negative power output terminal P2 and the rectifier input terminal P4 are connected together.

Figure 1:
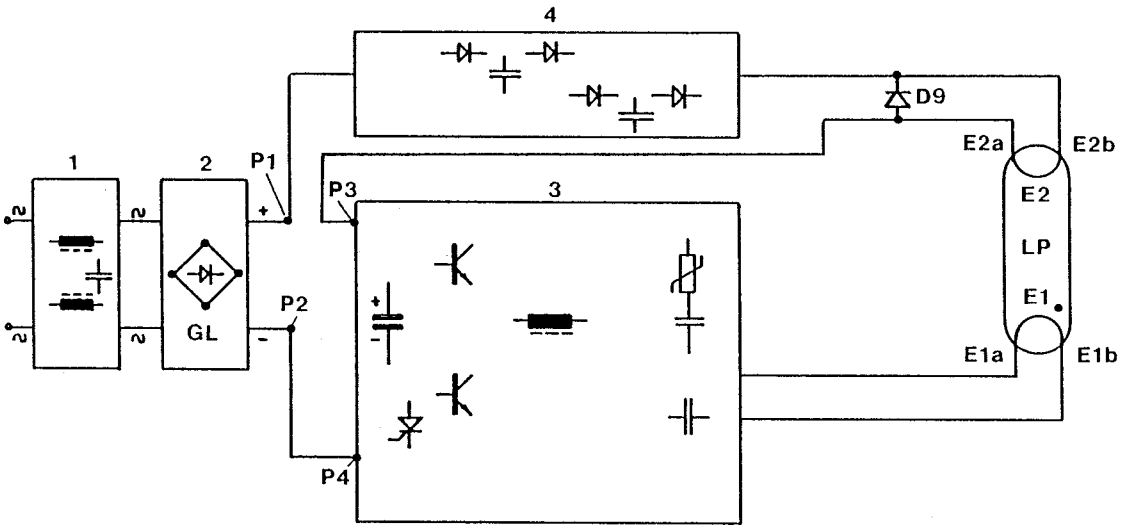
Figure 2:
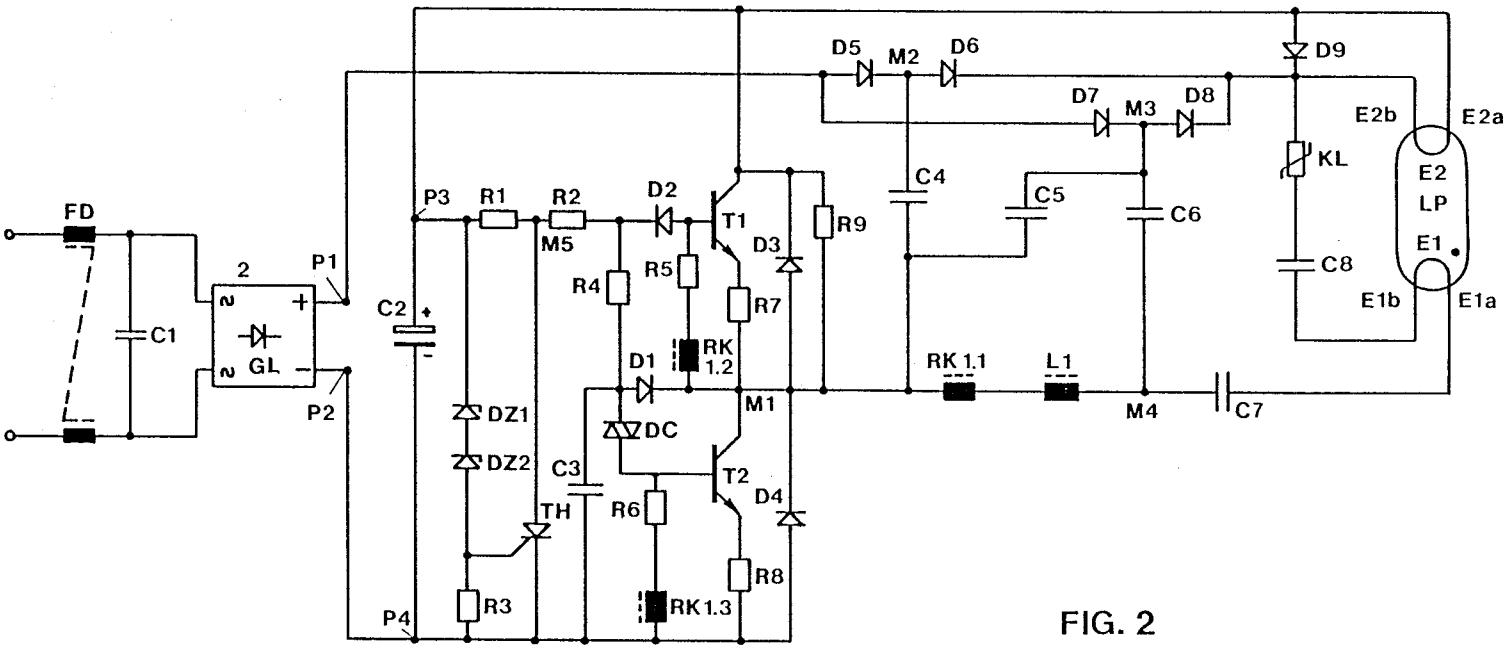

The detailed circuit is shown in FIG. 2, which illustrates a complete circuit to operate a fluorescent lamp, with restarting in accordance with the present invention.

A current compensated filter choke FD is located directly at the network input. A filter capacitor C1 is connected across the input lines, behind the choke FD. The choke FD and the capacitor C1 form the high-frequency filter 1. Rectifier 2 is formed as a power rectifier GL, the output terminals of which are connected to a push-pull frequency generator. The push-pull frequency generator has two equally poled transistors T1, T2, bridged by bypassing reverse current diodes D3, D4. Resistors R5 to R8 form the respective coupling resistors. A starting capacitor C3, diode D1, and the diac DC, together with the resistors R4, R9 and inductive windings of a transformer, complete the oscillatory circuit. The oscillator or generator operates on the feedback principle and is formed by the primary winding RK1.1 and two secondary windings RK1.2 and RK1.3 of a feedback transformer. The fluorescent lamp LP has the terminal E1*a* of the electrode E1 connected to the center junction M1 between the main current paths of the transistors T1 and T2. A series resonance circuit, formed by the resonance inductance L1, coupling capacitor C7 and resonance capacitor C8, is provided. The resonance inductance L1 and the coupling capacitor C7 are connected between the primary winding RK1.1 of the feedback transformer and the electrode terminal E1*a* of electrode E1. The resonance capacitor C8 is connected between the electrode terminal E1*b* of electrode E1 and electrode terminal E2*b* of electrode E2. A smoothing capacitor C2 is connected parallel to the switching paths of the transistors T1, T2.

In accordance with a feature of the invention, the electrode terminal E2*b* is connected to the positive terminal of the power rectifier 2, GL, preferably through the harmonic filter 4. Terminal E2*a* is connected to supply the transistor oscillator.

The basic operation of the circuit in push-pull operation, with the series resonance circuit for ignition and operation of such a low-pressure discharge circuit is well known, and described in the referenced patents and publication. The PTC resistor KL, which is connected in series with the resonance capacitor C8, and ahead of the terminal E2*b* of electrode E2, is used to reduce the heating current when the electrodes have been suitably preheated. The reduction can be to about 1/10 of the normal heating current.

The circuit includes an active harmonic filter 4. The filter is formed by two diodes D5, D6, poled in forward direction, and connected to the positive terminal of the rectifier GL. The center junction M2 between the diodes D5, D6 is coupled through a capacitor C4 with the center junction M1 between the transistors T1 and T2. The harmonic filter further includes two additional diodes, connected in forward current passing direction, with respect to the rectifier GL, namely diodes D7, D8, and likewise connected to the positive terminal of the rectifier GL parallel to the first diodes D5, D6. The central junction M3 between the diodes D7, D8 is coupled through a capacitor C5 to the junction M1 between the transistors T1, T2 and further over a capacitor C6 to the junction M4 between the resonance inductance L1 and the coupling capacitor C7. Capacitor C6 additionally functions as resonance capacitor when the heater current through the PTC resistor KL is reduced after the electrodes have been preheated.

The capacitors of the harmonic filter continuously pump energy into the smoothing capacitor C2, thereby ensuring that the power taken by the system from the power network is essentially sinusoidal. The exact operation of the function of the harmonic filter is described in Ser. No. 07/069,857, Zuchtriegel, assigned to the assignee of the present application, and the disclosures of which is hereby incorporated by reference.

Continuous feedback of energy may lead to overload, and thus destruction of the capacitor C2 if the lamp LP should fail, for example should have an air leak or the like. To prevent failure of the circuit, therefore, an additional turn-off circuit is provided, including trigger control therefor. This turn-off circuit is formed by the series circuit of the diode D2, a resistor R2, and a thyristor TH which couples the base of the transistor T1 with the negative terminal of the power rectifier GL. The center junction M5 between the resistor R2 and the thyristor TH is coupled over a resistor R1 with the positive terminal of the smoothing capacitor C2. The trigger circuit, itself, is formed by the Zener diodes DZ1 and DZ2, which are serially connected, and couple the gate of the thyristor TH with the positive terminal of the smoothing capacitor C2, and the resistor R3 which forms the gate resistor to connect the gate of the thyristor TH with the cathode thereof.

OPERATION OF THE PROTECTIVE CIRCUIT

If the voltage at the smoothing capacitor C2 exceeds a predetermined maximum value, the two Zener diodes DZ1 and DZ2 will become conductive with the same breakdown voltage and thus trigger the turn-off thyristor TH. This removes control energy from the base of the transistor T1 by providing, effectively, a short circuit to the negative terminal of the power rectifier GL. The transistor will block, and the resonance circuit formed by the inductance L1, capacitor C7 and capacitor C8 will become inactive. The connection of the thyristor TH over the resistor R1 with the positive terminal of the power rectifier GL holds the thyristor TH in conductive state, so that each renewed beginning of an oscillatory undulation is inhibited. The diode D2 blocks a–c voltage from the anode circuit of the thyristor TH.

In accordance with a feature of the invention, the electrode E2 is connected in series with the harmonic filter, that is, the diodes D4, D5 and D7, D8 and the positive input supply of the transistor T1 of the push-pull generator. By connecting the electrode E2 in series with the output from the power rectifier GL, through the harmonic filter 4, and the input to the push-pull frequency generator, failure of the lamp or removal of the lamp LP will break the connection between the power rectifier and the push-pull frequency generator. This positively disconnects the push-pull frequency generator and, further, causes the thyristor TH to block. Thus, if the lamp is removed, the disconnect circuit is not active, so that no power is wasted in the holding current circuit.

If a new lamp is placed into the sockets provided therefor, the generator can start immediately, since the thyristor disconnect circuit was placed out of operation due to removal of a defective lamp.

In accordance with a preferred feature of the invention, a diode D9 bridges the terminals E2*b* and E2*a* in direct current blocking direction. The electrodes are preheated in accordance with the circuit operation. This preheating, however, absent the diode D9, would be non-uniform for the electrodes, since the connection of the electrode E2 between the network component GL and the frequency generator would result in an additional preheating of the electrode E2 due to d-c current. The diode D9 reduces the preheat current on the electrode E2 to about half the value, which it might have if the diode D9 were absent, so that, with half current being applied to the electrode E2, both electrodes are heated and loaded approximately equally.

Suitable circuit elements for a 36 W fluorescent lamp, and having the circuit of FIG. 2, are given in the table attached hereto, which forms part of the present application.

Various changes and modifications may be made within the scope of the inventive concept.

| | |
|---|---|
| FD | 2 × 60 mH |
| C1 | 0, 22 μF |
| GL | B 250 C800 GP |
| C2 | 10 μF/450 V |
| R1 | 68 KΩ/2W |
| R2 | 120Ω/1W |
| DZ1, DZ2 | ZGP 10–250 |
| R3 | 1 kΩ/0, 3 W |
| TH | TAG X0 103 MA |
| R4, R9 | 470 kΩ/0, 6 W |
| C3 | 100 nF/100 V |
| DC | N 413 M |
| D1, D2, D9 | 1 N 4007 GP |
| R5, R6 | 8, 2 Ω |
| T1, T2 | BUT 54 |
| R7, R8 | 0, 56 Ω |
| RK 1.1, RK 1.2, RK 1.3 | RK 13 × 7 × 5<br>n 1.1 = 7 turns<br>n 1.2 = n 1.3 = 1 turn |
| D3 bis D8 | RGP 10 J |
| C4 | 4, 7 nF |
| C5, C6 | 10 nF |
| C8 | 15 nF |
| L1 | EF 25, 1 mH |
| KL | PTC 875 |

I claim:

1. High-frequency fluorescent lamp operating circuit in combination with a fluorescent lamp (LP) having a first lamp filament forming a first lamp electrode (E1) and a second lamp filament forming a second lamp electrode (E2), said circuit having a power rectifier (2, GL) having output terminals (P1, P2);

a push-pull transistor frequency generator (3) having two supply terminals (P3, P4), two interconnected alternately conducting transistors (T1, T2) defining a common junction (M1), and an operating circuit for the transistors including a feedback and control circuit (RK1.1, RK1.2, RK1.3; DC);

a smoothing capacitor (C2) connected across the supply terminals (P3, P4) of the operating circuit for the transistors; and a series resonance circuit having a series inductance (L1) defining two terminals and having a first terminal connected to the common junction (M1) of the transistors (T1, T2) and a second terminal (M4) connected to a series capacitor means (C6, C8) and through the first lamp filament of the first lamp electrode (E1), and comprising, in accordance with the invention, means for deenergizing the lamp operating circuit upon failure of the second lamp filament of the second electrode or upon removal of the lamp, and for also enhancing preheating of the filaments of the lamp, including a connection circuit from one (P1) of said output terminals (P1, P2) of the power rectifier (2, GL) through the second lamp filament of the second lamp electrode (E2) to the second input terminal (P3) of the push-pull transistor frequency generator (3).

2. The circuit of claim 1, further comprising a bridging diode (D9) connected across the second filament of the second electrode (E2) and polarized in blocking direction with respect to direct current flow through said filament from the power rectifier (2, GL).

3. The circuit of claim 1, further including a disconnect circuit coupled to the first one (T1) of said transistors (T1, T2) including a diode (D2) and a resistor (R2) and a thyristor (TH), connected in series through the main current path of the thyristor, and forming a series branching circuit coupled to the base of said transistor (T1), and a coupling resistor (R1) connecting one (P3) of said supply terminals (P3, P4) to one of the terminals of the coupling resistor (R1), the other terminal of the coupling resistor being connected to one of the main current carrying terminals (anode) of said thyristor (TH);

and voltage sensitive connection means (DZ1, DZ2, R3) connecting the gate of the thyristor across said supply terminals (P3, P4) for triggering the thyristor if the voltage at the supply terminals exceeds a predetermined value, to thereby render the thyristor conductive and bypass control voltages to the base of said one transistor (T1) and thereby inhibit oscillation of said push-pull transistor frequency generator (3).

4. The circuit of claim 3, further comprising a bridging diode (D9) connected across the second filament of the second electrode (E2) and polarized in blocking direction with respect to direct current flow through said filament from the power rectifier (2, GL).

5. The circuit of claim 1, further including a harmonic filter (D5, D6, D7, D8; C4, C5) included in said connection circuit.

6. The circuit of claim 5, wherein said harmonic filter is coupled in said connection circuit between one output terminal (P1) of the power rectifier (2, GL) and one terminal (E2*b*) of the second filament of the second lamp electrode (E2).

7. The circuit of claim 5, further comprising a bridging diode (D9) connected across the second filament of the second electrode (E2) and polarized in blocking direction with respect to direct current flow through said filament from the power rectifier (2, GL).

* * * * *